US011076456B2

(12) United States Patent
Yang

(10) Patent No.: US 11,076,456 B2
(45) Date of Patent: Jul. 27, 2021

(54) ADAPTING CIRCUIT FOR DRIVING A MAGNETRON WITH MULTIPLE SWITCHING POWER SUPPLIES

(71) Applicant: Yixin Yang, Olney, MD (US)

(72) Inventor: Yixin Yang, Olney, MD (US)

( * ) Notice: Subject to any disclaimer, the term of this patent is extended or adjusted under 35 U.S.C. 154(b) by 0 days.

(21) Appl. No.: 16/207,239

(22) Filed: Dec. 3, 2018

(65) Prior Publication Data

US 2020/0178359 A1 Jun. 4, 2020

(51) Int. Cl.

| | |
|---|---|
| ***H05B 6/68*** | (2006.01) |
| ***H01J 25/50*** | (2006.01) |
| ***H01J 23/54*** | (2006.01) |

(52) U.S. Cl.

CPC ..... *H05B 6/683* (2013.01); *H01J 23/54* (2013.01); *H01J 25/50* (2013.01)

(58) Field of Classification Search

None

See application file for complete search history.

(56) References Cited

U.S. PATENT DOCUMENTS 6,222,169 B1 * 4/2001 Han ..... H02M 7/60 219/702

FOREIGN PATENT DOCUMENTS

WO WO-2005069695 A1 * 7/2005 ..... H01F 27/255

* cited by examiner

*Primary Examiner* — Dedei K Hammond

(57) ABSTRACT

An adapting circuit is connected onto the high voltage end output of a magnetron driving power supply. In the adapting circuit, the high frequency part of current in the magnetron anode loop is converted into a part of the filament driving current. The high frequency part is removed by the two primary coils of a ferret core transformer and converted into a larger current on the secondary coil, which is rectified and filtered to increase the driving current in the magnetron filament loop. Two or more power supplies connected with the adapting circuits are connected together in parallel to drive a high power and high filament driving current magnetron with a correct compensation for its filament current.

3 Claims, 5 Drawing Sheets

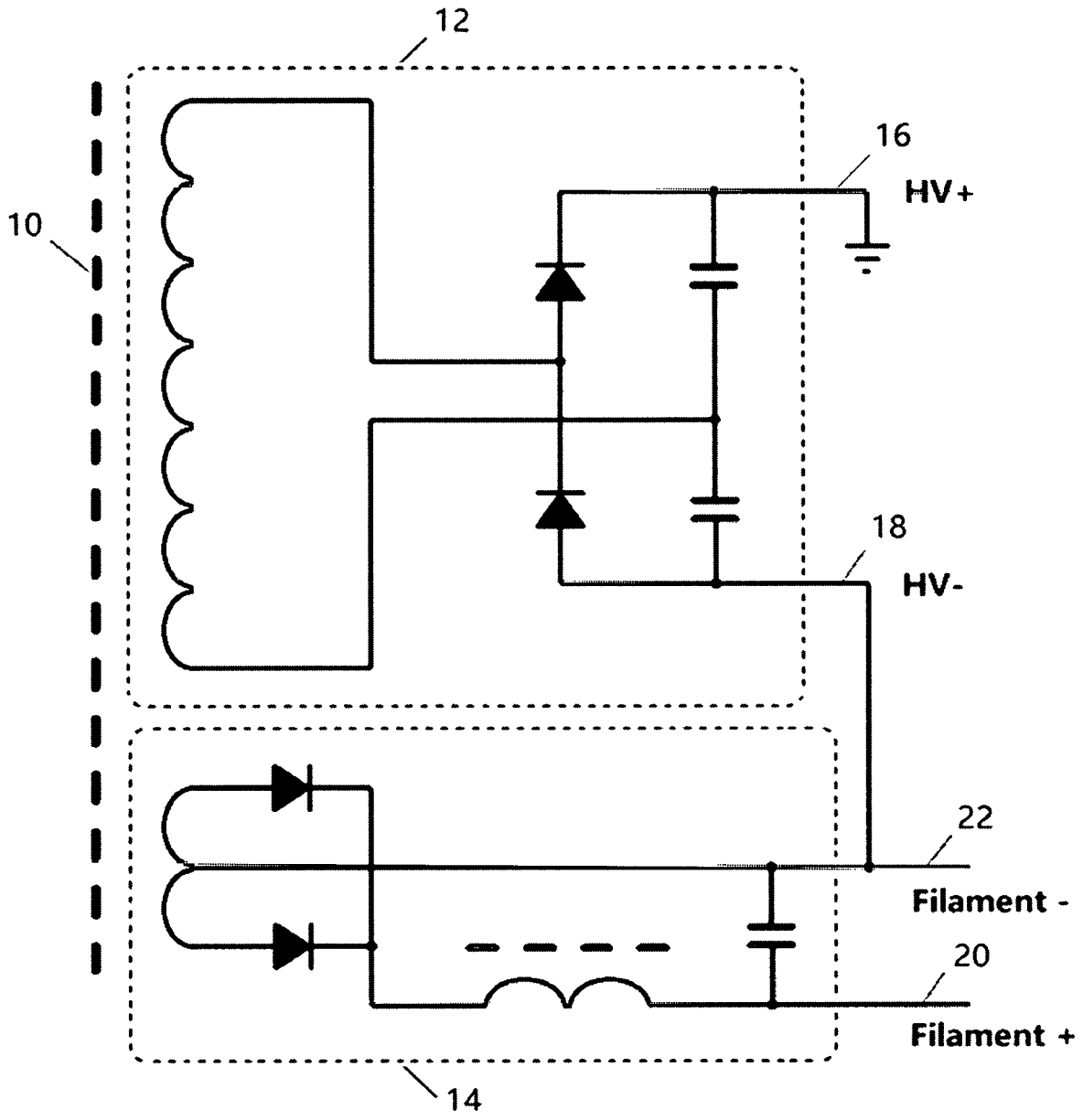
Figure 1 The secondary winding circuit of the main transformer in an iMOT power supply

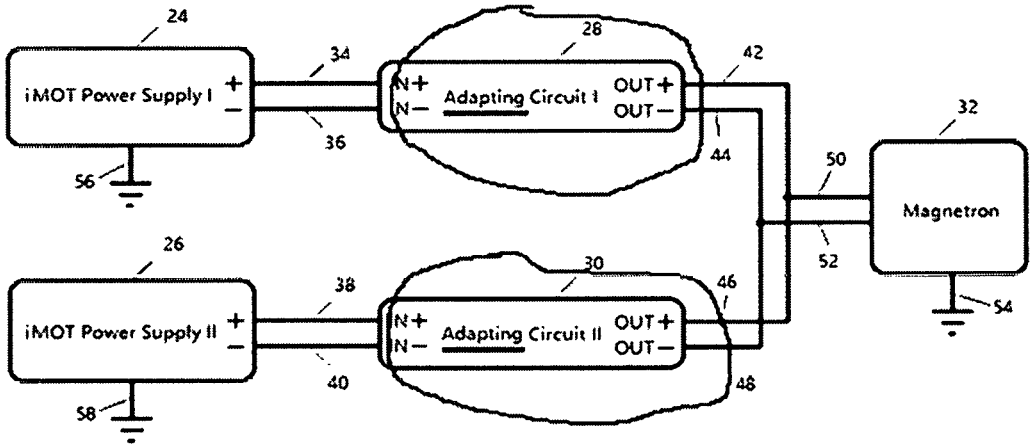
Figure 2 Two iMOT Power Supplies are connected with the Adaptingve Circuits for Driving One Magnetron

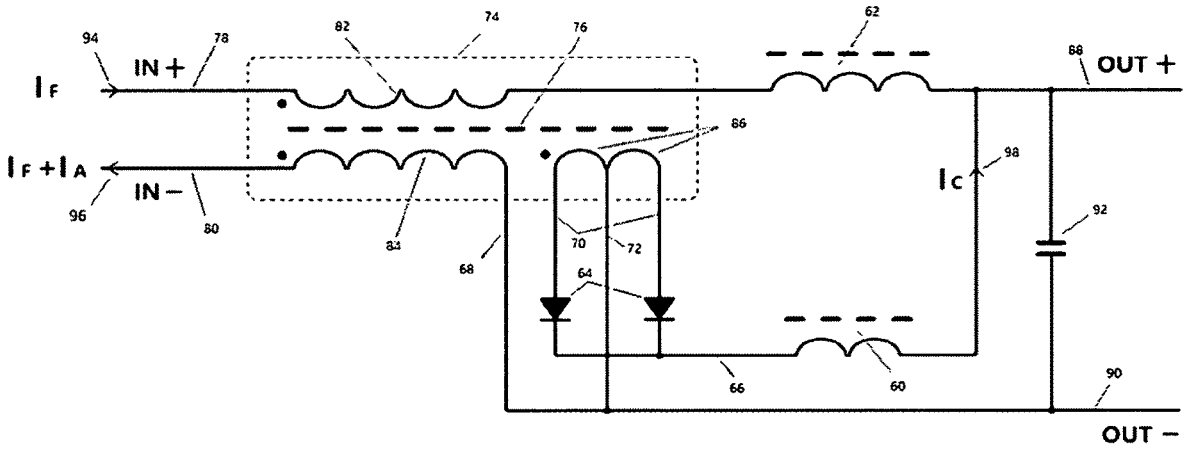
Figure 3 The Architecture of Adaptingve Circuit

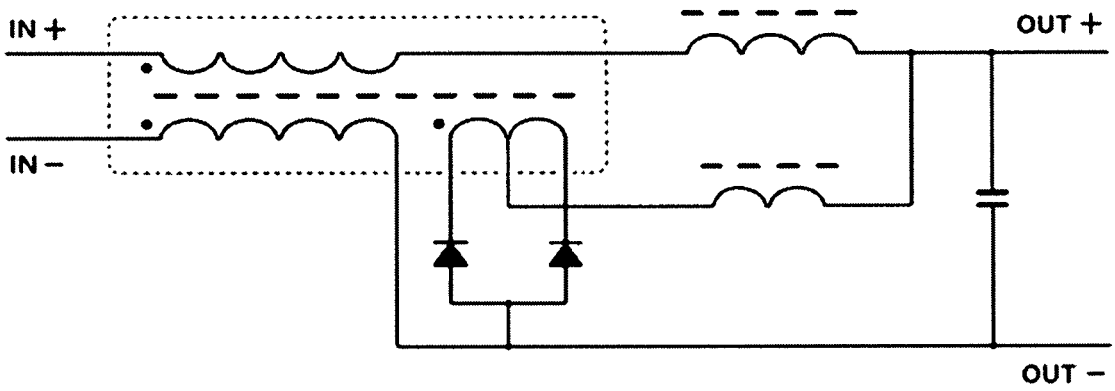
Figure 4 One Equivalent Architecture of the Adaptingve Circuit

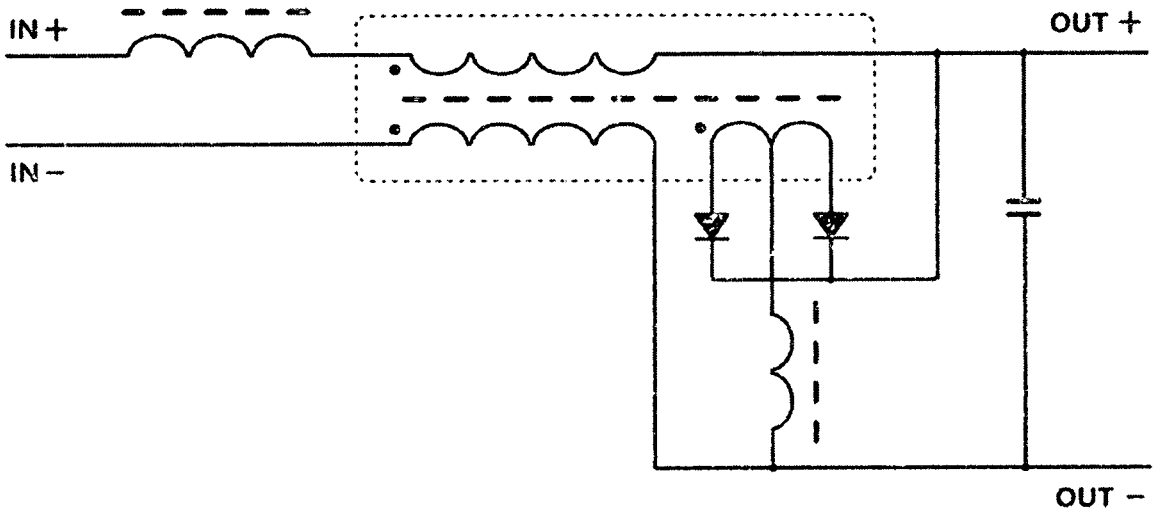
Figure 5 Another Equivalent Architecture of the Adaptingve Circuit

ADAPTING CIRCUIT FOR DRIVING A MAGNETRON WITH MULTIPLE SWITCHING POWER SUPPLIES

FIELD OF THE INVENTION

The invention relates magnetron drivers or magnetron power supplies.

BACKGROUND OF THE INVENTION

In 80's, a few types of high voltage switching mode power supplies were developed by manufacturers for driving magnetrons in microwave oven. These types of power supplies have a very simple architecture by using a single transformer to drive both the anode and filament of magnetron for the lowest cost.

Today, these Microwave Oven Types (MOT) of power supplies are widely used for not only microwave ovens but also many other commercial and industrial magnetron driving applications. Due to large volume productions are applied on MOT power supplies by many manufacturers, their performance to cost ratio is very high, as well as their reliability was proven excellent in many applications. Therefore, combining two or more of MOT power supplies becomes a fast and economic way for driving a larger power magnetron.

Since MOT power supplies were originally designed for microwave ovens, magnetrons in such the application are commercial level products, thus, the output power of MOT power supplies is a value in the range of 900 W to 1400 W, anode voltage is 4.2 KV and filament voltage is 3.3V. When MOT power supplies are used for driving a larger power industrial magnetron, such as 2 KW, with 4.2 KV anode voltage and 4.8V filament voltage, it would not work to simply connect two or more power supplies in parallel because the 3.3V filament driving voltage on MOT power supplies is lower than 4.8V filament voltage the magnetron needs. Therefore, an additional circuit that doesn't change any components on MOT power supplies is needed to adapt the difference of filament voltages between 3.3V and 4.8V.

In a Basic MOT power supply, the secondary winding for driving the filament of a magnetron is just a coil without any extra circuit, driving current in the filament loop is high frequency Alternating Current (AC). For a longer life time of a magnetron's filament, the basic MOT power supply was improved by add a rectifying and filtering circuit to make the filament driving current as a Direct Current (DC). FIG. 1 illustrates the secondary winding circuit of the main transformer in an improved MOT (iMOT) power supply. The High Voltage (HV) output circuit 12 has one positive output wire 16 and one negative output wire 18, and filament output circuit 14 has one positive output wire 20 and one negative output wire 22. The secondary coils of HV output circuit 12 and filament output circuit 14 share the same transformer ferrite core 10. The positive output wire 16 of HV output circuit 12 is tied to Ground, and the negative output wire 18 is connected to the negative output wire 22 of the filament output circuit 14. Therefore, the output wires 20 and 22 are two high voltage outlet terminals to drive a magnetron with a DC filament current and a negative DC HV current, where the positive terminal 20 provides filament current as the positive polarity, and the negative terminal 22 combines anode driving current and filament driving current together as the negative polarity. Due to a simple filtering is applied on the HV output circuit 12, the high frequency part on the HV loop current is very large.

SUMMARY OF THE INVENTION

An adapting circuit is provided to connect two or more iMOT switching power supplies for driving a magnetron. There is a ferrite core transformer in the adapting circuit, the primary coil of the transformer is connected into the anode loop in series, the secondary coil of the transformer is connected to a rectifier and filtering circuit and then to be connected into the filament loop in parallel. Thus, the high frequency part current in the anode loop of each power supply is partly converted into the current in filament loop. By changing the number of turns and turn ratio of primary and secondary coils, a correct compensation for filament driving current is converted from the anode loop to the filament loop to meet a higher filament driving requirement for an industrial magnetron.

BRIEF DESCRIPTION OF THE DRAWINGS

FIG. 1, The secondary winding circuit of the main transformer in an iMOT power supply.

FIG. 2, Two iMOT Power Supplies are connected with the Adapting Circuits for Driving One Magnetron.

FIG. 3, The Architecture of Adapting Circuit.

FIG. 4, One Equivalent Architecture of the Adapting Circuit.

FIG. 5, Another Equivalent Architecture of the Adapting Circuit.

DETAILED DESCRIPTION OF THE INVENTION

FIG. 2 shows that two iMOT power supplies are connected with the Adapting Circuits for driving one magnetron. iMOT power supply I 24 and iMOT power supply II 26 are identical, and adapting circuit I 28 and adapting circuit II 30 are also the same circuit.

The two outlet terminals 20 and 22 of iMOT power supply I 24 are connected to the input positive polarity, IN+ and negative polarity, IN− of the adapting circuit I 28 respectively via wires 34 and 36, and the two outlet terminals 20 and 22 of iMOT power supply II 26 are connected to the input positive polarity, IN+, and negative polarity, IN− of the adapting circuit II 30 respectively via wires 38 and 40. the output positive polarities, OUT+ and negative polarities, OUT− of the adapting circuit I 28 and adapting circuit II 30 are connected in parallel respectively, where the wire 42 from OUT+ of adapting circuit I 28 is connected with the wire 46 from OUT+ of adapting circuit II 30 together as the input wire 50 to drive one high voltage end of magnetron 32, and the wire 44 from OUT− of adapting circuit I 28 is connected with the wire 48 from OUT− of adapting circuit II 30 together as the input wire 52 to drive the other high voltage end of magnetron 32. Ground ends of Magnetron 32, iMOT power supply I 24 and iMOT power supply II 26 are tide to ground by wires 54, 56 and 58 as the return of Anode loop. Adapting circuit I 28 and adapting circuit II 30 are HV end circuits without any grounding connections.

FIG. 3 illustrates the architecture of the Adapting Circuit that consists of a high frequency transformer 74, a pair of Schottky diodes 64, a first inductor 62, a second inductor 60, and a capacitor 92. The high frequency transformer 74 has a ferrite core 76, a first primary coils 82, a second primary coil 84 and a center tap secondary coil 86. The two primary coils 82 and 84 are made up by using two wires with the same length together and winding them the same turns around the ferrite core 76. When the input terminals 78 and 80 are powered by an iMOT power supply, the filament current $I_F$ applied at the positive input terminal IN+ 78 in direction pointed to the right as arrow 94, the filament current return and anode current ($I_F$+$I_A$) applied at the negative input terminal IN− 80 in direction pointed to the left as arrow 96. Filament current passes the primary coil 82 and inductor 62 to reach the positive output terminal OUT+ 88, and then passes the filament of a magnetron that is connected to the output terminals OUT+ 88 and OUT− 90, then returns from the negative output terminal OUT− 90 via wire 68 and the primary coil 84 to the negative input terminal IN− 80. As a result, the filament current flows through two primary coils 82 and 84 in opposite directions to cancel each other in magnetic field creation. Only anode current passing the primary coils 84 creates magnetic field in the ferrite core 76, so high frequency part in the anode loop current can be converted as a current on the central tap secondary coil 86. By changing the turn ratio of the primary coils 82 and 84 to the secondary coil 86, a different value current can be converted on the secondary coil 86. The pair of Schottky diodes 64 rectify the high frequency AC current from the center tap secondary coil 86 into a DC current. After the rectifier, the positive polarity end is connected to one end of inductor 60 via wire 66 and negative polarity end is connected to the negative output OUT− 90 via wire 72. Inductor 60 and capacitor 99 is a LC filter to smooth the converted current at the positive output terminal OUT+ 88, so the current passed the filament is the summation of the filament driving current $I_F$ 94 from the iMOT power supply and the converted current $I_C$ 98 created by the secondary coil 86. In addition, inductor 62 is connected with the primary coil 82 in series between the positive input terminal IN+ 78 and the positive output terminal OUT+ 88, inductor 62 also works with capacitor 92 as a LC filter to smooth the filament current $I_F$ 94 from the iMOT power supply.

FIG. 4 shows one equivalent architecture of the adapting circuit, wherein the pair of Schottky diodes are connected reverse and their anodes are connected to the negative output OUT−. The center tap is connected to the positive output terminal OUT+ via an inductor.

FIG. 5 shows another equivalent architecture of the adapting circuit, wherein inductors swap positions with the primary and secondary coils of the ferrite transformer in their serial connections.

Any partly changing the combination of component connection based on the architecture of FIG. 3, FIG. 4 and FIG. 5 is also an equivalent architecture of the adapting circuit.

The invention claimed is:

1. An adapting circuit for connecting two or more iMOT switching power supplies for driving a magnetron, comprising: an input port comprising a first input terminal, and a second input terminal; an output port comprising a first output terminal, and a second output terminal; a transformer comprising two primary coils as a first primary coil and a second primary coil, a third center tap secondary coil, and a ferrite core; a pair of Schottky diodes; a capacitor; a first inductor; a second inductor; wherein the first input terminal of the input port and the first output terminal of the output port are connected by the first primary coil of the ferrite core transformer and the first inductor that are connected to each other in series; wherein the second input terminal of the input port and the second output terminal of the output port are connected by the second primary coil of the ferrite core transformer; wherein the polarity of the first primary coil of the ferrite connected to the first input terminal of the input port is the same as the polarity of the second primary coil of the ferrite core transformer connected to the second input terminal of the input port; wherein the third central tap secondary coil of the ferrite core transformer and the pair of Schottky diodes form a full wave rectifier; wherein the first output terminal and the second output terminal of the output port are connected by the full wave rectifier and the second inductor that are connected to each other in series.

2. The ferrite core transformer of claim 1 wherein the first primary coil further comprising a first outlet wire and a second outlet wire;

the second primary coil further comprising a third outlet wire and a fourth outlet wire;

the third central tap secondary coil further comprising a fifth outlet wire, a center tap and a sixth outlet wire;

the ferrite core;

wherein first primary coil and the second primary coil are identical in number of turns and winding direction around the ferrite core;

wherein first outlet wire of the first primary coil is connected to the first input terminals of the adapting circuit directly or via the first inductor, and second outlet wire of the first primary coil is connected to the first output terminals of the adapting circuit via the first inductor or directly;

wherein third outlet wire of the second primary coil is connected to the second input terminals of the adapting circuit, forth outlets wire of the second primary coil is connected to the second output terminals of the adapting circuit;

Wherein fifth and sixth outlet wires of the third center tap secondary coil are connected together via the pair of Schottky diodes as one polarity of a rectified DC source, the center tap of the third center tap secondary coil is the other polarity of the rectified DC source; positive polarity of the DC source is connected to the first output terminal of the output port directly or via the second inductor, and negative polarity of the DC source is connected to the second output terminal of the output port via the second inductor or directly.

3. The adapting circuit of claim 1 is connected as a junction circuit between two or more iMOT switching power supplies and the magnetron; wherein a high voltage output end of each iMOT switching power supply is connected to the input port of the adapting circuit; the output ports of the adapting circuit is connected in parallel to a high voltage end of the magnetron.

* * * * *